US008602514B2

(12) United States Patent
Higashikawa

(10) Patent No.: US 8,602,514 B2
(45) Date of Patent: Dec. 10, 2013

(54) DRIVE CONTROL DEVICE OF ACTUATOR AND INKJET PRINTER PROVIDED WITH THE SAME

(75) Inventor: Reiko Higashikawa, Nagoya (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 255 days.

(21) Appl. No.: 13/031,758

(22) Filed: Feb. 22, 2011

(65) Prior Publication Data

US 2011/0210999 A1 Sep. 1, 2011

(30) Foreign Application Priority Data

Feb. 26, 2010 (JP) ..... 2010-041636

(51) Int. Cl.
*B41J 29/38* (2006.01)

(52) U.S. Cl.
USPC ..... 347/9

(58) Field of Classification Search
USPC ..... 347/9, 10, 57, 71; 349/151; 174/254
See application file for complete search history.

(56) References Cited

U.S. PATENT DOCUMENTS 4,687,300 A * 8/1987 Kubo et al. ..... 349/151
7,381,901 B2 * 6/2008 Tanaka et al. ..... 174/254
2002/0180815 A1 * 12/2002 Nou ..... 347/10
2005/0253883 A1 11/2005 Kato
2006/0044363 A1 * 3/2006 Katayama ..... 347/71
2006/0197806 A1 * 9/2006 Komatsu ..... 347/57
2010/0128075 A1 * 5/2010 Yamashita ..... 347/9

FOREIGN PATENT DOCUMENTS

| | | |
|---|---|---|
| CN | 1739966 | 3/2006 |
| JP | 2005324453 | 11/2005 |
| JP | 2007083707 | 4/2007 |
| JP | 2007123401 | 5/2007 |

OTHER PUBLICATIONS

Notification of a First Office Action for Chinese Patent Application No. 201110048519.3 dated Jul. 3, 2013.

* cited by examiner

*Primary Examiner* — Manish S Shah
*Assistant Examiner* — Yaovi Ameh
(74) *Attorney, Agent, or Firm* — Frommer Lawrence & Haug LLP

(57) ABSTRACT

There is provided a drive control device including: a wiring board connected to an actuator; two driver ICs each having a plurality of common signal input terminals and selection signal input terminals arranged in one direction; and a control section transmitting a plurality of types of common signals and selection signals to the two driver ICs, respectively, in which the two driver ICs are disposed to face to each other on the wiring board so that the common signal input terminals in the respective driver ICs are each arranged in reverse directions to each other, and the paired common signal input terminals that are disposed in the one direction in the same order when counted from one side are wired respectively.

9 Claims, 13 Drawing Sheets

DRIVE CONTROL DEVICE OF ACTUATOR AND INKJET PRINTER PROVIDED WITH THE SAME

CROSS REFERENCE TO RELATED APPLICATION

The present application claims priority from Japanese Patent Application No. 2010-041636, filed on Feb. 26, 2010, the disclosure of which is incorporated herein by reference in its entirety.

BACKGROUND OF THE INVENTION

1. Field of the Invention

The present invention relates to a drive control device controlling driving of an actuator and to an ink-jet printer provided with the same.

2. Description of the Related Art

In Japanese Patent Application Laid-open No. 2007-83707, there has been disclosed a structure for driving actuators for an ink-jet head provided with a plurality of nozzles. The above ink-jet head is provided with an actuator unit including a plurality of piezoelectric deformation sections that selectively jet liquid droplets of ink from the nozzles. A flexible printed circuit (FPC) having a driver IC mounted thereon is connected to the above actuator unit, and further the FPC is connected to a control board (relay circuit board) via a flexible flat cable (FFC).

Although details are not described in Japanese Patent Application Laid-open No. 2007-83707, the driver IC drives the respective actuators in the actuator unit in the following manner. A plurality of types of driving waveform signals (see FIG. 7 in an embodiment in the present application) corresponding to types of liquid droplets (for example, sizes of liquid droplets) to be jetted from the respective nozzles and a waveform selection signal for selecting the single type from the plurality of types of driving waveforms are transmitted to the driver IC from the control board. The driver IC supplies a drive signal having the driving waveform selected based on the waveform selection signal to each of the piezoelectric deformation sections to make the piezoelectric deformation section jet the liquid droplet of the type corresponding to the driving waveform from the nozzle.

SUMMARY OF THE INVENTION

In recent years, the number of nozzles to be provided on a head tends to increase in order to further speed up printing. When the number of nozzles increases, the number of piezoelectric deformation sections also increases. However, there is a limit to driving too many piezoelectric deformation sections by one driver IC. Thus, the present applicant has been considering driving an actuator unit including a plurality of piezoelectric deformation sections by two driver ICs.

At this time, circuit configurations of the two driver ICs and specifications of input/output terminals and the like are preferably identical in terms of cost. Further, in order to prevent input wirings to the driver ICs from a control board from interfering with a large number of output wirings from output terminals (OUT) in the driver ICs to the actuator unit as much as possible, as shown in FIG. 13, it is preferable that two driver ICs 47 with the same configuration are disposed so that input terminals (IN) in the driver IC 47 on one side and input terminals (IN) in the driver IC 47 on the other side face to each other. Further, it is preferable that the input wirings (wirings 103 and so on) which are connected to the driver ICs 47 are positioned between the two driver ICs 47.

For example, six types of driving waveform signals in FIG. 7 are common signals to be used when selecting a waveform in each of the two driver ICs 47 and are inputted in common to the two driver ICs 47 from the control board. In FIG. 13, six input terminals 55 (FIRE1 to FIRE6) indicate common signal input terminals to which the six types of driving waveform signals being the common signals are inputted. That is, the single wiring 103 (common wiring) through which the single type of driving waveform signal is transmitted from the control board branches in the middle, and branch lines 103*a* are connected to the same common signal input terminals 55 (for example, FIRED in two driver ICs 47*a*, 47*b*. Incidentally, the waveform selection signal for selecting the single driving waveform from the six types of driving waveforms is set for each of the piezoelectric deformation sections. Thus, the waveform selection signal is individually inputted to each of the two driver ICs 47 from the control board. In FIG. 13, four input terminals 54 (SIN_0 to SIN_3) in each of the driver ICs 47 indicate selection signal input terminals to which the waveform selection signals are inputted.

As shown in FIG. 13, when the input terminals (IN) in the two driver ICs 47 with the same configuration are disposed to face to each other, in the two driver ICs 47, directions in which the common signal input terminals 55 (FIRE1 to FIRE6) are arranged are reversed to each other. That is, in the driver IC 47*a* positioned at the upper side in FIG. 13, the common signal input terminals 55 are arranged in the order of FIRE1→FIRE6 from the left, and on the other hand, in the driver IC 47*b* positioned at the lower side in FIG. 13, the common signal input terminals 55 are arranged in the order of FIRE6→FIRE1 from the left. Thus, when the single common wiring 103 through which the single type of driving waveform signal is transmitted is desired to be connected to the common signal input terminals 55 with the same number in the two driver ICs 47, there is a need to make the branch lines 103*a* of the six common wirings 103 intersect with one another as shown in FIG. 13. However, the intersections of the common wirings 103 each results in a factor generating a noise in each of the signals, so that such intersections are preferably reduced as much as possible.

An object of the present invention is to reduce a portion in which common wirings through which a common signal is inputted to two driver ICs from a control board intersect with each other as much as possible and to prevent a noise from mixing into the common signal.

According to a first aspect of the present invention, there is provided a drive control device which controls driving of an actuator, including:

a wiring board connected to the actuator;

two driver ICs which are mounted on the wiring board, each of which generates a drive signal for driving the actuator, and each of which includes a plurality of input terminals arranged in one direction; and a control section which is connected to the wiring board, which generates a plurality of types of common signals to be used in common in the two driver ICs and a plurality of types of selection signals for selecting one type of the common signals from the plurality of types of common signals, and which sends the common signals and the selection signals to the two driver ICs, respectively, to control the two driver ICs, wherein the input terminals in each of the driver ICs include a plurality of common signal input terminals to which the plurality of types of common signals are inputted and a plurality of selection signal input terminals to which the selection signals are inputted, the wiring board includes a plurality of common wirings which connect the common signal input terminals in one of the two driver ICs and the common signal input terminals in the other of the two driver ICs, respectively, and through which the plurality of types of common signals are inputted to the common signal input terminals in both of the two driver ICs, respectively, and the two driver ICs are disposed on the wiring board to face to each other so that the common signal input terminals in one of the driver ICs and the common signal input terminals in the other driver IC are arranged in reverse order with respect to one another, and two common signal input terminals, of the common signal input terminals, which are provided in the two driver ICs, respectively, and which are disposed in a same arrangement order when counted from one side of the wiring board in the one direction are wired by one of the common wirings.

In the present invention, in the drive control device driving the actuator by the two driver ICs, for example, the plurality of input terminals in the two driver ICs with the same configuration are disposed to face to each other. In the above case, arrangement rows of the plurality of input terminals are reversed to each other in the two driver ICs. Thus, arrangement rows of the plurality of common signal input terminals included in the plurality of input terminals are also reversed to each other in the two driver ICs. Thus, for example, when one common wiring is desired to be connected to the common signal input terminals with the same number in the two driver ICs, the common wiring intersects with the common wirings, and thereby noises are easily mixed into the common signals. However, in the present teaching, at least the single common wiring is connected to the two common signal input terminals different in number, so that the intersections of the common wirings are reduced and the mixture of noise caused by the intersection is prevented.

In the drive control device according to the present teaching, in each of the driver ICs, the common signal input terminals may arranged to align in the one direction, and are individually numbered in order of the alignment from one end of the one of the driver ICs in the one direction, each of the driver ICs may include a signal selection circuit which selects the one type of the common signals to be used for generating the drive signal from the common signals inputted from the plurality of common signal input terminals respectively, based on the selection signal, under a condition that one of the plurality of types of selection signals is inputted from the selection signal input terminal, one of the common wirings may be connected to the two common signal input terminals which are provided in the two driver ICs respectively and are numbered in different numbers, the control section may generate the plurality of types of selection signals corresponding to the numbers of the common signal input terminals, and in the case when the signal selection circuits selects the common signals to be transmitted to the two driver ICs by the common wiring connected to the two common signal input terminals which are numbered in different numbers between the two driver ICs respectively, the control section may transmit the different selection signals corresponding to the different numbers to the two driver ICs, respectively.

Each of the signal selection circuits of the driver ICs selects one type of common signals from the common signals inputted from the common signal input terminals. Therefore, as described above, when a common wire is connected to two of different numbered common signal input terminals (when different kinds of common signals are send to the same numbered common signal input terminals of the two driver ICs), the common signal selected by the signal selection circuit based on the selection signal may differ from the desired common signal set by the control section.

In the present invention, the control section generates the plurality of selection signals to correspond to the numbers of the common signal input terminals. In other words, the signal selection circuit selects the common signal inputted to the common signal input terminal having the number which corresponds to the selection signal inputted from the control section. Therefore, in the present teaching, the control section sends different kinds of selection signals which correspond to the different terminal numbers to the two driver ICs, when the signal selection circuit should select a predetermined common signal which is transmitted via a common wire connected to the two different numbered common signal input terminals of the two driver ICs. That is, the control section identifies or determines the terminal number of the common signal input terminal to which the common signal that should be selected by each of the driver ICs is inputted. Therefore, even though a common wire is connected to the two different numbered common signal input terminals of the two driver ICs, there is no fear that undesired common signal different from the desired common signal is selected in the driver ICs.

In the present teaching, the control section informs the signal selection circuit, by the selection signal, of the terminal number of the common signal input terminal to which the common signal that should be selected is inputted. Therefore, in the drive ICs, the signal selection circuit just selects the common signal inputted from the common signal input terminal having the number corresponding to the selection signal, and the configuration of the circuits of the driver ICs does not become complicated.

In the drive control device of the present teaching, pairs of the common signal input terminals may be connected by the common wirings, respectively. Each of the pairs of the common signal input terminals may include two of the common signal input terminals of the two driver ICs, and arrangement orders of the two of the common input terminals in the one direction from one side of the wiring board may be the same.

When the common wirings are connected to the common signal input terminals, arrangement orders of which is the same when counted from one side in the one direction, respectively, the numbers of the intersections of the common wirings can be reduced.

In the drive control device of the present teaching, the wiring board may be a flexible board.

When the wiring board on which the common wirings are wired is the flexible board, the flexibility of the flexible board decreases at the intersections of the wirings. Therefore it is preferable that the numbers of the intersections of the wirings can be reduced.

In the drive control device of the present teaching, the common signal input terminals may be arranged to align in the one direction, and are individually numbered in order of the alignment from one end of the one of the driver ICs in the one direction, each of the driver ICs may include a signal selection circuit which selects the one type of the common signals to be used for generating the drive signal from the common signals inputted from the plurality of common signal input terminals respectively, based on the selection signal, under a condition that one of the plurality of types of selection signals is inputted from the selection signal input terminal, one of the common wirings may be connected to the two common signal input terminals which are provided in the two driver ICs respectively and may be numbered in different numbers, the control section may generate the plurality of types of selection signals corresponding to the plurality of types of common signals respectively, the control section may transmit an IC identification signal to the two driver ICs to inform each of the driver ICs as to which one of the two driver ICs the informed driver IC corresponds to, and the signal selection circuits may specify the number of the common signal input terminal to which the common signal is inputted based on the IC identification signal, under a condition that the selection signals, which correspond to the common signals to be transmitted to the two driver ICs via the common wiring that is connected to the two common signal input terminals numbered in different numbers between the two driver ICs, respectively, are inputted.

In the present teaching, at least one common wiring is connected to the two different numbered common signal input terminals. Therefore, the numbers of the intersections of the common wirings can be reduced, and noise mixing due to the intersections can be suppressed. In this case, the plurality of kinds of the selection signals do not correspond to the numbers (terminal numbers) of the common signal input terminals, but the plurality of kinds of the selection signals correspond to the plurality kinds of common signals per se.

When one kind of the common signal, which is transmitted from the control section via one of the common wirings, is inputted to the different numbered common signal input terminals of the two driver ICs, the numbers of the common signal input terminals to which the one kind of the common signal is inputted are different in the two driver ICs. In this case, the signal selection circuit of the driver IC can not identify the number of the common signal input terminal to which the common signal that should be selected is inputted, by the selection signal only.

Therefore, in the present teaching, the control section transmits an IC identification signal to the two driver ICs to inform the driver ICs as to which one of the two driver ICs the informed driver IC corresponds to. The signal selection circuit of the driver IC recognizes as to which one of the two driver ICs, each of the signal selection circuits corresponds to, by the IC identification signal sent from the control section, and identifies the number of the common signal input terminal to which the common signal corresponding to the inputted selection signal is inputted.

According to a second aspect of the present invention, there is provided an ink-jet printer being an ink-jet printer performing printing by jetting a liquid droplet of ink onto a medium, the ink-jet printer including:

a transporting mechanism transporting a medium in a transporting direction; and an ink-jet head including an actuator that applies pressure to ink and jetting a liquid droplet of the ink onto the medium transported by the transporting mechanism; and the drive control device according to the first aspect of the present invention that is connected to the actuator.

At least the single common wiring from the control section is connected to the two common signal input terminals different in number in the two driver ICs to thereby reduce the intersections of the common wirings, so that the mixture of noise caused by the intersection can be prevented. Further, although the single common wiring is connected to the common signal input terminals different in number between the two driver ICs, for example, the control section designates the number of the common signal input terminal to which the common signal that should be selected by a signal selection circuit in each of the driver ICs is inputted, or transmits, to each of the driver ICs, an IC identification signal for making the signal selection circuit recognize as to which one of the two driver ICs disposed on the wiring board the driver IC corresponds to, and thereby there is no case that the signal different from the common signal set by the control section is selected on a side of each of the driver ICs.

DETAILED DESCRIPTION OF THE PREFERRED EMBODIMENTS

Next, an embodiment of the present teaching will be explained. This embodiment is one example of applying the present teaching to an ink-jet printer provided with an ink-jet head jetting a liquid droplet of ink onto a recoding paper.

Figure 1:
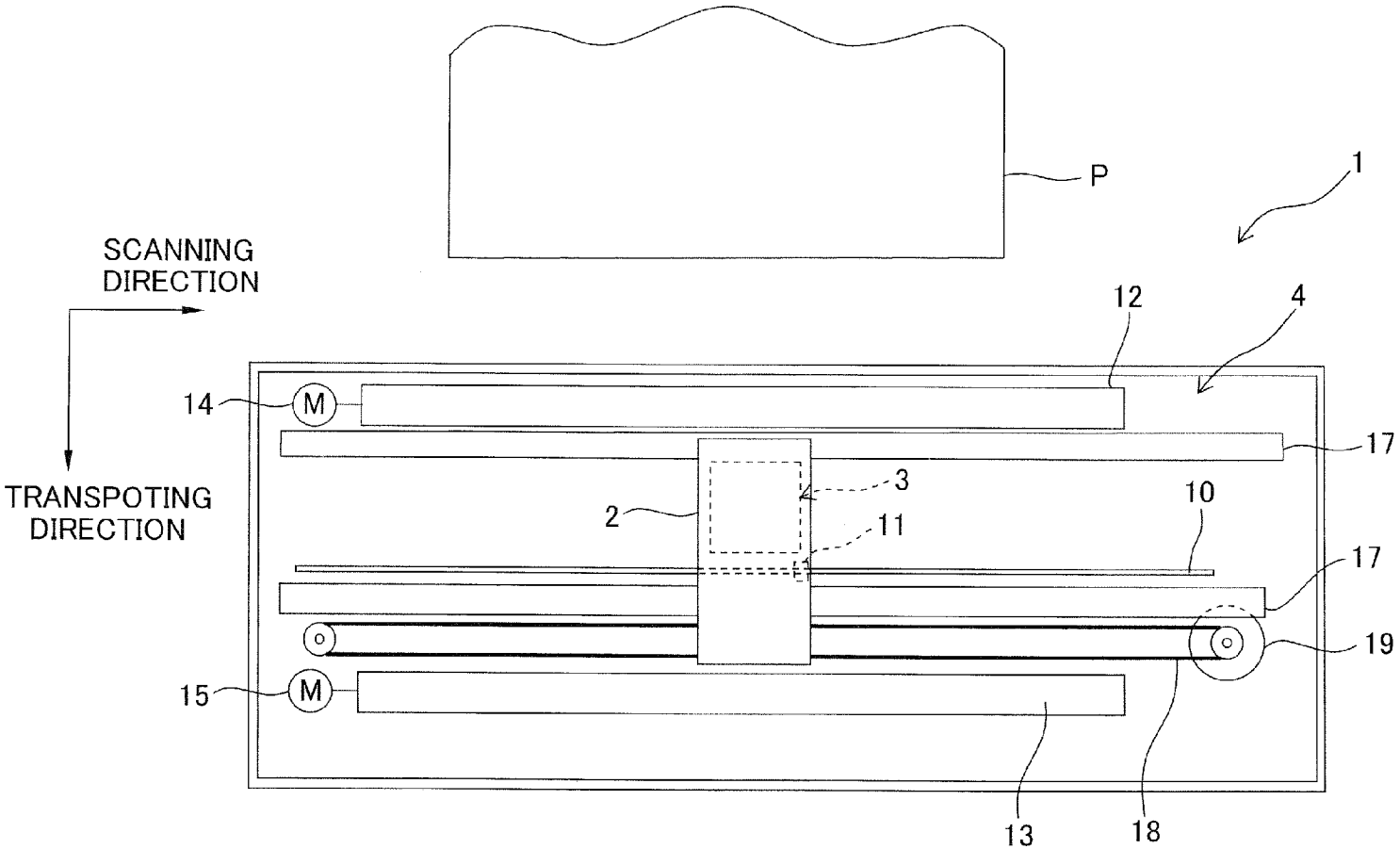
FIG. 1 is a schematic plane view of an ink-jet printer according to an embodiment.

First, a schematic structure of an ink jet printer 1 (liquid droplet jetting apparatus) in this embodiment will be explained. As shown in FIG. 1, the printer 1 is provided with a carriage 2 formed to be capable of reciprocating along a scanning direction (right and left direction in FIG. 1), an ink-jet head 3 mounted on the above carriage 2, a transporting mechanism 4 transporting a recording paper P in a transporting direction perpendicular to the scanning direction, and so on. Note that the transporting direction is not necessarily perpendicular to the scanning direction. The phrase that "the transporting direction is perpendicular to the scanning direction" also includes the case in which the transporting direction is substantially perpendicular to the scanning direction.

The carriage 2 is formed to be capable of reciprocating along two guide shafts 17 extending parallel in the scanning direction (right and left direction in FIG. 1). Further, an endless belt 18 is coupled to the carriage 2, and the carriage 2 is designed, when the endless belt 18 is driven to run by a carriage drive motor 19, to move in the scanning direction as the endless belt 18 runs. Incidentally, in the printer 1, a linear encoder 10 including a plurality of light-transmitting portions (slits) arranged at intervals in the scanning direction is provided. On the other hand, in the carriage 2, a transmission-type photosensor 11 including a light-emitting element and a light-receiving element is provided. Then, the printer 1 is formed to be able to recognize a current position of the carriage 2 in the scanning direction by counted values of the light-transmitting portions of the linear encoder 10 detected (the number of times of the detection) by the photosensor 11 during the movement of the carriage 2.

On the above carriage 2, the ink-jet head 3 is mounted. A plurality of nozzles 30 (see FIG. 2, FIG. 3(*a*), and FIG. 3(*b*)) are provided on a lower surface of the ink-jet head 3. The above ink-jet head 3 is formed to jet, from the nozzles 30, ink supplied from a not-illustrated ink cartridge onto the receding paper P to be transported toward a downstream side in the transporting direction (see FIG. 1) by the transporting mechanism 4.

The transporting mechanism 4 includes a paper feeding roller 12 disposed on an upstream side of the ink-jet head 3 in the transporting direction and a paper discharge roller 13 disposed on a downstream side of the ink-jet head 3 in the transporting direction. The paper feeding roller 12 and the paper discharge roller 13 are rotary-driven by a paper feeding motor 14 and a paper discharge motor 15, respectively. Then, the above transporting mechanism 4 transports the recording paper P to the ink-jet head 3 from the upstream side in the transporting direction by the paper feeding roller 12, and discharges the recording paper P on which an image, a letter, or the like is recorded by the ink jet head 3 to the downstream side in the transporting direction by the paper discharge roller 13.

Figure 2:
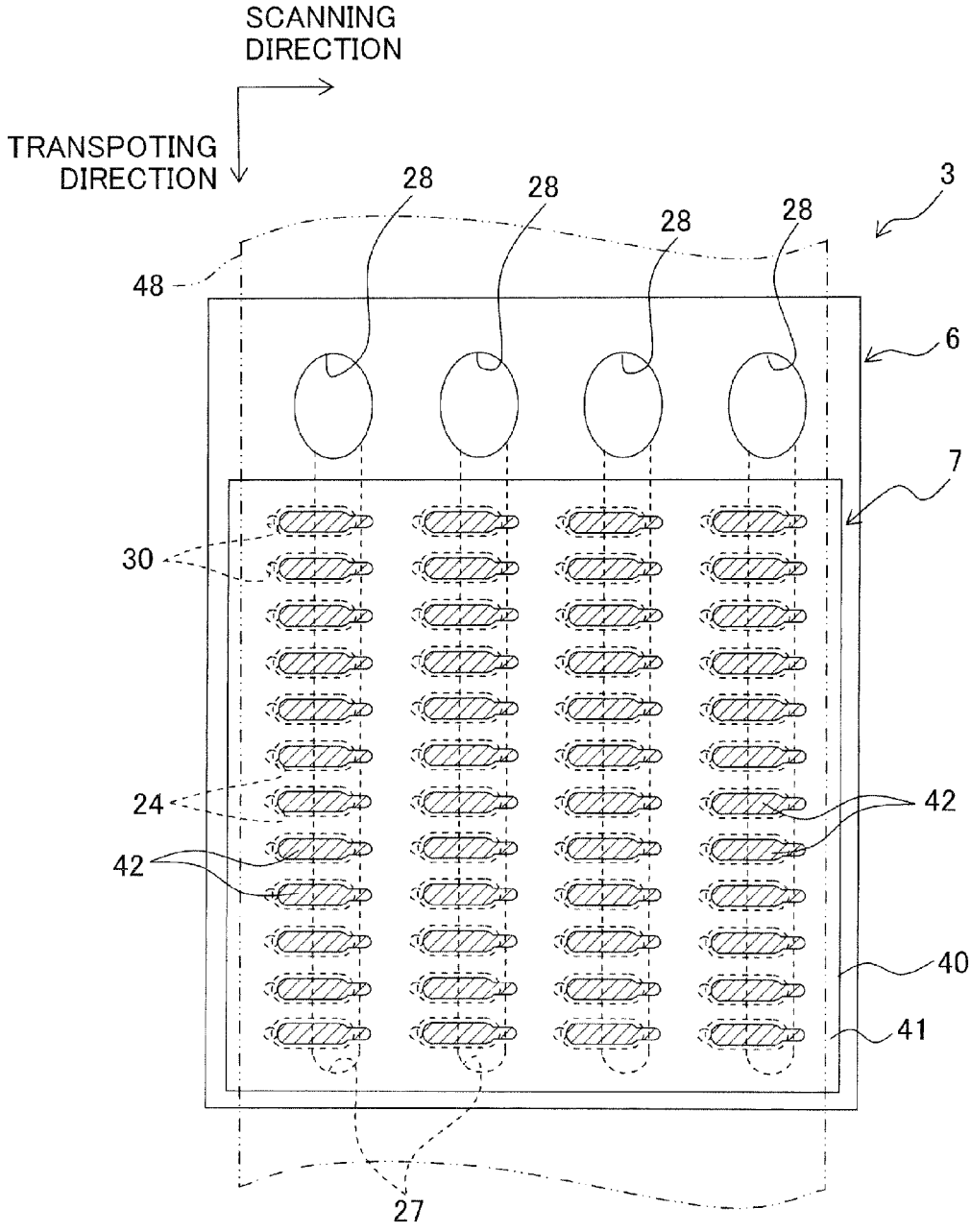
FIG. 2 is a plane view of an ink-jet head.
Figure 3A:
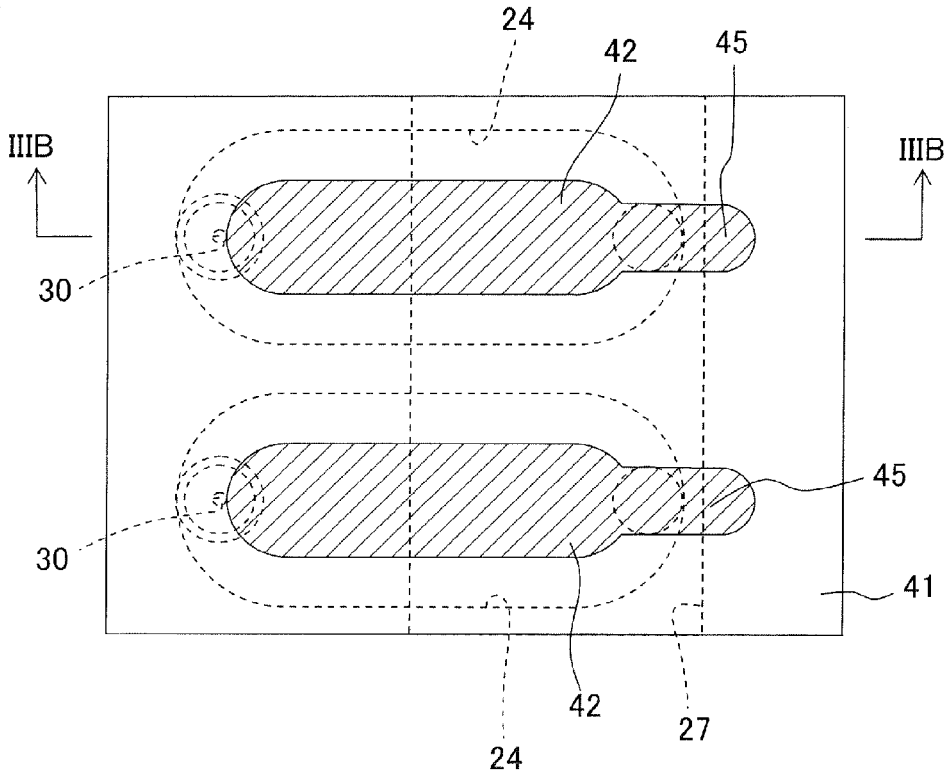
FIG. 3A is an enlarged plane view of FIG. 2
Figure 3B:
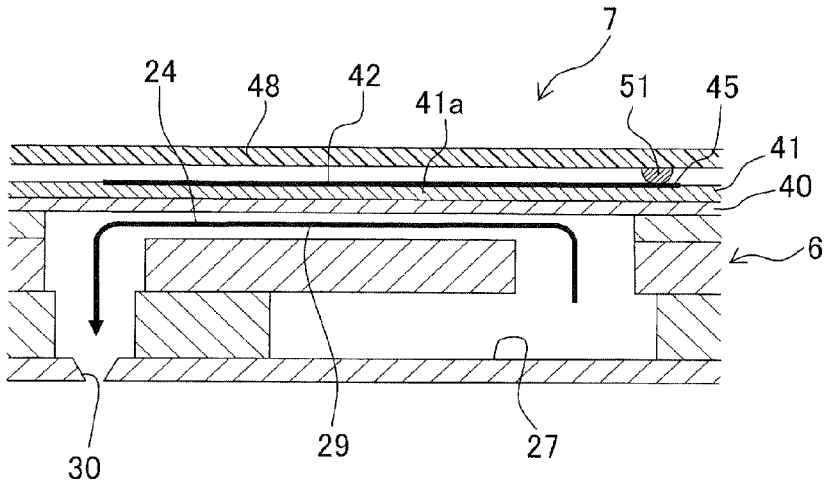
FIG. 3B is a cross-sectional view taken along B-B line in FIG. 3A, in which illustration of a FPC shown in FIG. 3B is omitted in FIG. 3A.

Next, the ink jet head 3 will be explained. As shown in FIGS. 2, 3(*a*), and 3(*b*), the ink-jet head 3 is provided with a channel unit 6 having ink channels that include the nozzles 30 and pressure chambers 24 formed therein and a piezoelectric actuator 7 applying pressures to inks in the pressure chambers 24. Further, as shown by a two-dot chain line in FIG. 2, a flexible printed circuit (FPC) 48 (see FIG. 5) is joined to an upper surface of the piezoelectric actuator 7.

As shown in FIG. 3(*a*), the channel unit 6 has a structure in which four plates are stacked, and has the ink channels formed therein. The nozzles 30 are formed on a lower surface of the channel unit 6. As shown in FIG. 2, these nozzles 30 form four nozzle rows each extending in the transporting direction. The four nozzle rows are arranged side by side in the scanning direction. Four color inks of yellow, cyan, magenta, and black are jetted from the nozzles 30 belonging to these four nozzle rows respectively. Further, the plurality of pressure chambers 24 communicating with the nozzles 30 respectively are formed in the channel unit 6. The pressure chambers 24 form four pressure chamber rows corresponding to the four nozzle rows. Further, four manifolds 27 extending in the transporting direction are formed in the channel unit 6. The four manifolds 27 supply the four color inks of yellow, cyan, magenta, and black to the pressure chambers included in the four pressure chamber rows respectively. Incidentally, the four manifolds 27 continue to four ink supply ports 28 formed on an upper surface of the channel unit 6.

Then, as shown in FIG. 3(*b*), in the channel unit 6, the manifolds 27 continuing to the ink supply ports 28 communicate with the pressure chambers 24, and further the pressure chambers 24 communicate with the nozzles 30, respectively. That is, a plurality of individual ink channels 29 are formed in the channel unit 6, each from one of the manifolds 27 to one of the nozzles 30 via one of the pressure chambers 24.

Next, the piezoelectric actuator 7 will be explained. As shown in FIGS. 2, 3(*a*), and 3(*b*), the piezoelectric actuator 7 is provided with a vibration plate 40 disposed on the upper surface of the channel unit 6 so that the piezoelectric actuator 7 covers the pressure chambers 24, a piezoelectric layer 41 disposed on an upper surface or the above vibration plate 40 to face the pressure chambers 24, and a plurality of individual electrodes 42 disposed on an upper surface of the piezoelectric layer 41.

The vibration plate 40 is a metal plate having a substantially rectangular shape in a plane view. The vibration plate 40 covers the pressure chambers 24, and is joined to the channel unit 6. Further, the upper surface of the conductive vibration plate 40 is disposed on a lower surface side of the piezoelectric layer 41, and thereby the vibration plate 40 serves as a common electrode that generates an electric field in a thickness direction in the piezoelectric layer 41 between the vibration plate 40 and the individual electrodes 42 disposed on the upper surface of the piezoelectric layer 41. The vibration plate 40 as the above common electrode is connected to ground terminals of later-described driver ICs 47 (see FIGS. 4 to 6) and is constantly kept at ground potential.

The piezoelectric layer 41 is made of a piezoelectric material whose major component is, for example, lead zirconate titanate (PZT) that is a solid solution of lead titanate and lead zirconate and is a ferroelectric. As shown in FIGS. 2, 3(*a*), and 3(*b*), the piezoelectric layer 41 is continuously formed on the upper surface of the vibration plate 40 over all the pressure chambers 24. Further, of the piezoelectric layer 41, at least regions facing the pressure chambers 24 are each polarized in the thickness direction.

The individual electrodes 42 are disposed on the upper surface of the piezoelectric layer 41 at the regions facing the pressure chambers 24 respectively. As shown in FIG. 3(*a*), the individual electrodes 42, in a plane view, each have a substantially elliptical shape slightly smaller than the pressure chamber 24 and face center portions of the pressure chambers 24. Further, a plurality of contact portions 45 are led out from end portions of the individual electrodes 42 along a longitudinal direction of the individual electrodes 42 respectively. As shown in FIG. 3(*b*), the contact portions 45 are connected to a plurality of connection terminals 51 provided on the FPC 48 respectively.

Figure 4:
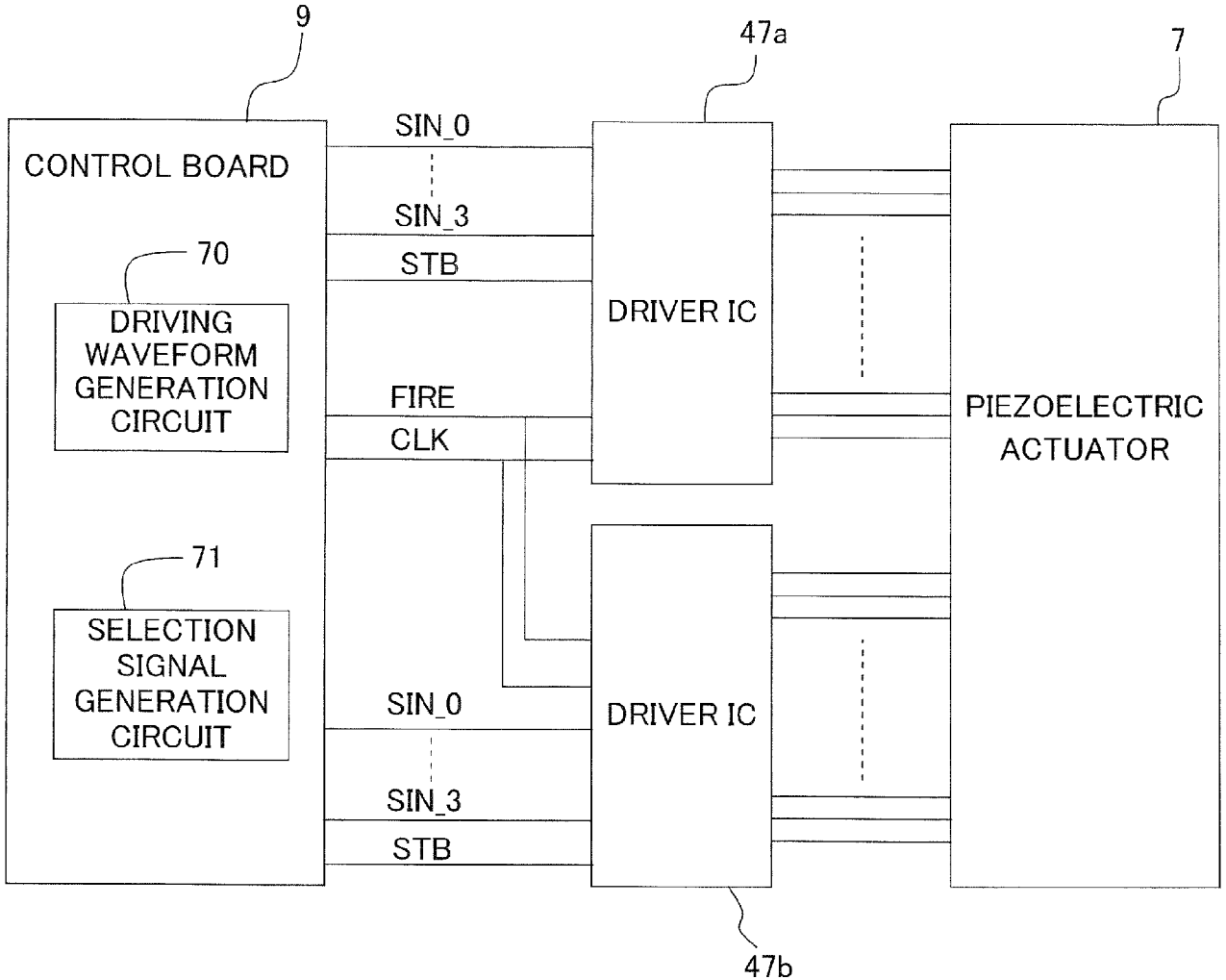
FIG. 4 is a view schematically showing electrical connection of a piezoelectric actuator in the ink-jet head and a control board.

As shown in FIG. 4, the two driver ICs 47 (47*a*, 47*b*) are connected to the piezoelectric actuator 7, and further the two driver ICs 47 are connected to a control board 9 (corresponding to a control section in the present teaching). The two driver ICs 47 supply drive signals having pulsed driving waveforms (see FIG. 7), which are generated based on various signals transmitted from the control board 9, to the individual electrodes 42 of the piezoelectric actuator 7 respectively, which will be described in detail later. That is, a potential of the individual electrode 42 is switched between the ground potential and a driving potential corresponding to a pulse height, depending on the driving waveform. Here, the various signals are respective signals of, for example, CLK, FIRE, SIN_0 to SIN_3, and STB, and details of these signals will be described later. Incidentally, the individual electrodes 42 to be driven definitely differ between the two driver ICs 47, and the driver IC 47*a* on one side is connected to some of the individual electrodes 42 of the piezoelectric actuator 7 and the driver IC 47*b* on the other side is connected to the other individual electrodes 42.

Next, the operation of the piezoelectric actuator 7 at the time of ink jetting will be explained. When the drive signal is supplied from one of the driver ICs 47 to a certain individual electrode 42 and a driving potential is applied to the above individual electrode 42, a potential difference occurs between the above individual electrode 42 to which the driving potential is applied and the vibration plate 40 as the common electrode kept at the ground potential, and thereby the electric field in the thickness direction acts in the piezoelectric layer 41 (an active portion 41*a*) sandwiched between the above individual electrode 42 and the vibration plate 40 shown in FIG. 3(*b*). The direction of the above electric field is parallel to a polarization direction of the piezoelectric layer 41, so that the active portion 41*a* of the piezoelectric layer 41 contracts in a plane direction perpendicular to the thickness direction. Here, the vibration plate 40 on a lower side of the piezoelectric layer 41 is fixed to the upper surface of the channel unit 6. Therefore, when the piezoelectric layer 41 positioned on the upper surface of the above vibration plate 40 contracts in the plane direction, the portion of the vibration plate 40 covering the pressure chamber 24 deforms to bulge toward the pressure chamber 24 (unimorph deformation). At this time, the volume of the pressure chamber 24 reduces to thereby increase the pressure of the ink in the pressure chamber 24, so that the ink is jetted from the nozzle 30 communicating with the above pressure chamber 24.

<A Drive Control Structure of the Piezoelectric Actuator>

Figure 5:
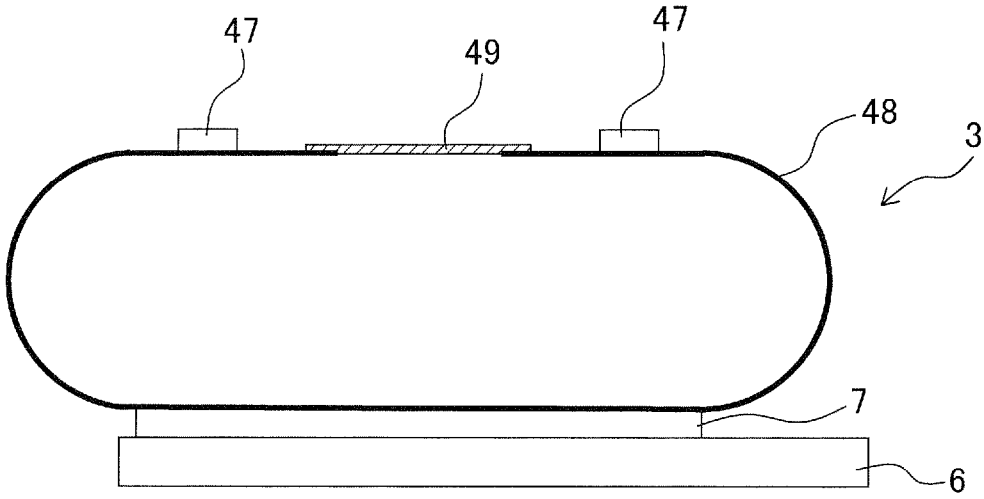
FIG. 5 is a side view when the ink-jet head in FIG. 2 is seen from the right side.

Next, a structure for drive-controlling the piezoelectric actuator 7 including the driver ICs 47 (a drive control device) will be explained in detail with reference to FIG. 5. In FIG. 5, the flexible printed circuit (FPC) 48 and the flexible flat cable (FFC) 49 that are positioned on the piezoelectric actuator 7, which have been simplified or omitted in FIG. 2 in order to simplify the drawing, are illustrated.

Figure 6:
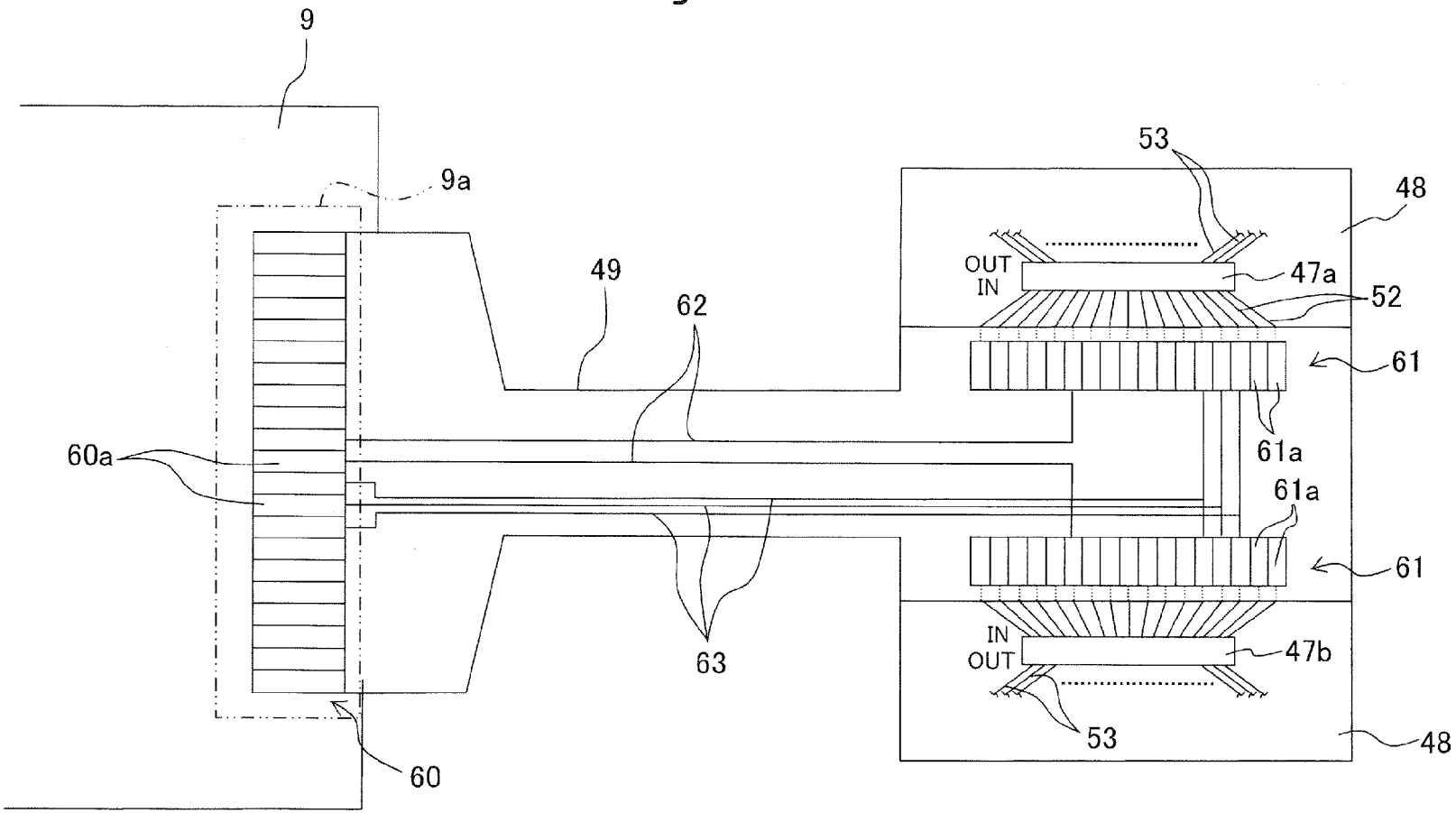
FIG. 6 is an upper surface view of the FPC and a FFC shown in FIG. 5.

As shown in FIG. 5, a center portion of the single FPC 48 that is elongated in one direction is joined to the upper surface of the piezoelectric actuator 7 having the individual electrodes 42 disposed thereon, and both side portions, of the above FPC 48, sandwiching the center portion joined to the piezoelectric actuator 7 are each folded up to extend upwardly, and the two driver ICs 47 are mounted on end portions of the both side portions, respectively. Further, as shown in FIG. 6, the both end portions of the FPC 48 are connected to two output sections 61 each having a plurality of output terminals 61*a* on the FFC 49. Further, an input section 60 having a plurality of input terminals 60*a* on the FFC 49 is connected to a connector 9*a* of the control board 9.

The two driver ICs 47 (47*a*, 47*b*) mounted on the both end portions of the FPC 48 respectively are ICs having the same configuration. That is, the internal circuit configurations, and specifications such as the number of input/output terminals and disposition are the same. These two driver ICs 47 are disposed on the FPC 48 so that a plurality of input terminals (IN) arranged in one direction in the driver IC 47*a* and a plurality of input terminals (IN) arranged in one direction in the driver IC 47*b* face to each other. Thus, a plurality of output terminals (OUT) of each of the driver ICs 47 are disposed outside. Further, the input terminals (IN) of each of the driver ICs 47 are connected to the output terminals 61*a* of the output section 61 on the FFC 49 by a plurality of input wirings 52 on the FPC 48. Further, the output terminals (OUT) of each of the driver ICs 47 are connected to the individual electrodes 42 of the piezoelectric actuator 7 by a plurality of output wirings 53 on the FPC 48.

Further, as shown in FIG. 6, a plurality of wirings 62, 63 through which the signals outputted from the control board 9 are transmitted to the two driver ICs 47 is formed on the FFC 49. In FIG. 6, only some of the wirings are illustrated in order to simplify the drawing, but in practice, the wirings connected to the input terminals 60*a* of the input section 60 respectively are formed on the FFC 49. Incidentally, a flexible wiring board structure combined with the FPC 48 and the FFC 49 corresponds to a "wiring board" in the present teaching. Here, the FPC 48 has the two driver ICs 47 mounted thereon, and the FFC 49 connects the FPC 48 and the control board 9 and has the wirings 62, 63 through which the signals are transmitted from the control board 9 to the driver ICs 47 formed thereon.

<Details of the Signals to be Inputted to the Driver ICs from the Control Board>

Next, the various signals to be inputted to the two driver ICs 47 from the control board 9 will be explained with reference to FIG. 4. First, in FIG. 4. "CLK" represents an input of a clock for data transfer from the control board 9 to the driver ICs 47 and "STB" represents an input of a strobe control signal to be used for controlling the driver ICs 47 respectively.

Further, the ink-jet printer 1 in this embodiment is designed to be able to select a size of a liquid droplet (a liquid-droplet volume) to be jetted from each of the nozzles 30, from five types of sizes in order to make multi-tone expression possible to achieve printing of an image of high image quality. That is, it is formed so that the single jetting mode can be selectively obtained for the single nozzle 30, from six types of jetting modes in total. Here, the six types of jetting modes include the mode (non-jetting mode) in which no liquid droplet is jetted and the five types of modes different in liquid-droplet volume.

The control board 9 includes a driving waveform generation circuit 70 generating the signals (FIRE signals) of the six types of driving waveforms (FIG. 7) corresponding to the above-described six types of jetting modes respectively and a selection signal generation circuit 71 generating waveform selection signals for selecting the single type from the six types of driving waveforms at each jetting timing of each of the nozzles 30.

The six types of driving waveform signals generated in the driving waveform generation circuit 70 are inputted to the driver ICs 47 from the control board 9. In FIG. 4, the single wiring through which the driving waveform signal (FIRE) is transmitted is only illustrated in order to simplify the drawing, but in practice, the six wirings through which the six types of driving waveform signals are transmitted respectively are provided on the FFC 49. Further, as shown in FIG. 4, the six types of driving waveform signals are used in common in the two driver ICs 47 respectively, so that these driving waveform signals are common signals to be inputted in common to the two driver ICs 47 from the control board 9.

Further, the waveform selection signals to be generated in the selection signal generation circuit 71 are six types of signals composed of combinations of 3-bit data (for example, "001", "100", and so on) so that the six types of driving waveforms can be distinguished with each other. Then, the waveform selection signals are serially inputted to the driver ICs 47 (SIN_0 to SIN_3) simultaneously with the inputs of the above-described six types of driving waveform signals.

Then, with respect to each of the nozzles 30, each of the driver ICs 47 generates the drive signal (drive pulse) having the driving waveform in accordance with the jetting mode assigned by the waveform selection signal to supply the generated drive signal to the individual electrode 42, corresponding to the nozzle 30, of the piezoelectric actuator 7. Incidentally, the waveform selection signal for selecting the single type from the six types of driving waveforms is set for each of the nozzles 30 (individual electrodes 42), and thus these waveform selection signals are signals to be individually inputted to each of the two driver ICs 47 from the control board 9, as shown in FIG. 4.

The waveforms (driving waveforms) of the drive signals corresponding to the six types of jetting modes respectively will be further explained. As described above, the five types of jetting modes, in which the non-jetting mode is excluded from the six types of jetting modes, are designed so that the volumes of liquid droplets to be jetted differ respectively. Further, an amount of the liquid droplet (the liquid-droplet volume) to be jetted from the nozzle 30 is proportion to the magnitude of pressure to be applied to the ink in the pressure chamber 24. Thus, the driver ICs 47 supply the drive signals different in waveform to the individual electrodes 42 of the piezoelectric actuator 7 so that the pressures to be applied to the inks in the pressure chambers 24 differ from one another. In the above case, it makes it possible to selectively jet the liquid droplets different in volume from the nozzles 30 by switching the potential of each of the individual electrodes 42 between the driving potential and the ground potential at an appropriate timing.

Figure 7:
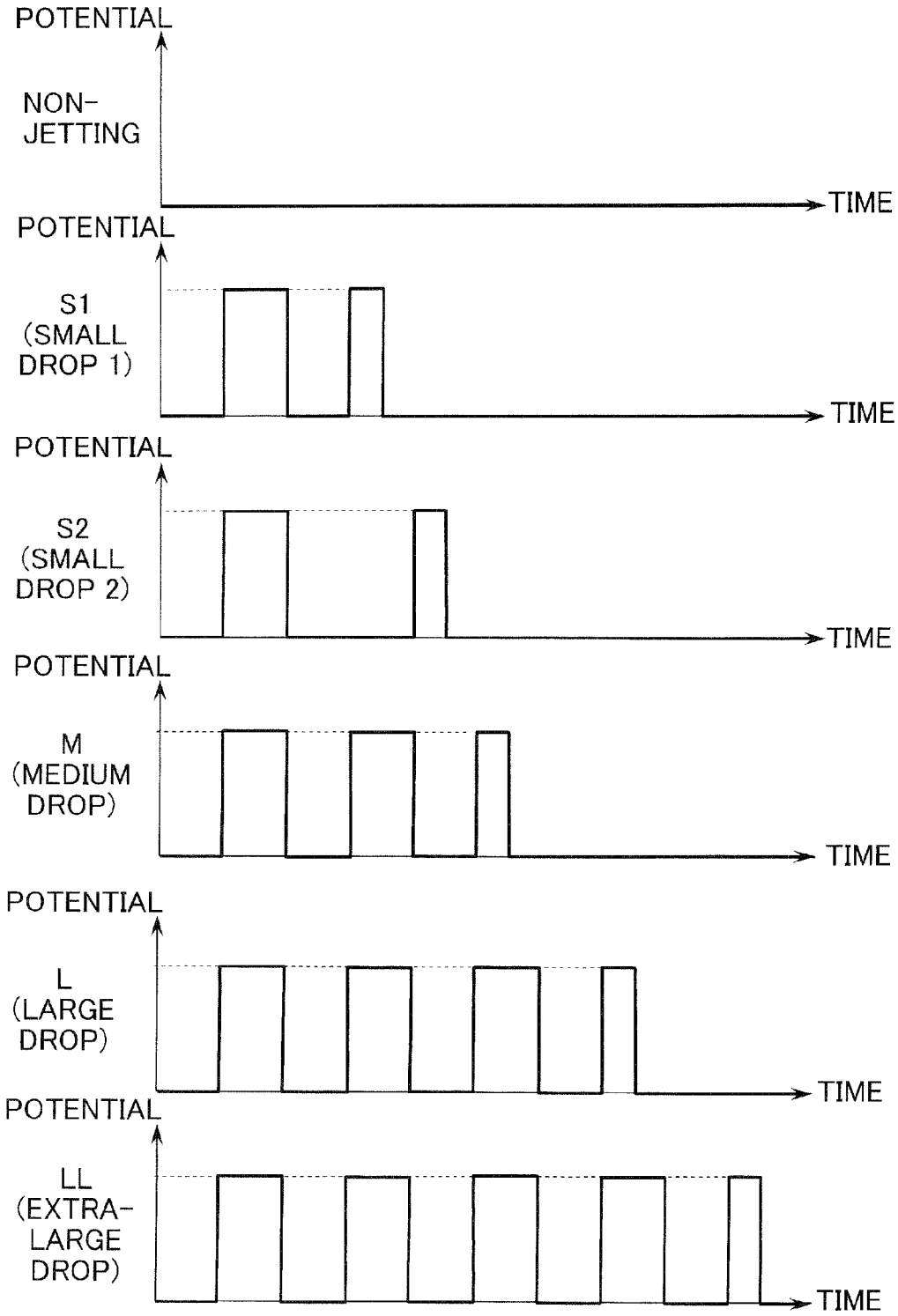
FIG. 7 is a view showing six types of driving waveforms corresponding to six types of jetting modes.

In FIG. 7, the six types of driving waveforms corresponding to the six types of jetting modes of non-jetting, S1 (small drop 1), S2 (small drop 2), M (medium drop), L (large drop), and LL (extra-large drop) respectively are shown. Then, the driver ICs 47 each select the single type from the above-described six types of driving waveforms and generate the drive signal with the selected waveform to apply it to the individual electrode 42 of the piezoelectric actuator 7.

<An Input/Output Terminal Structure of the Driver IC>

Figure 8:
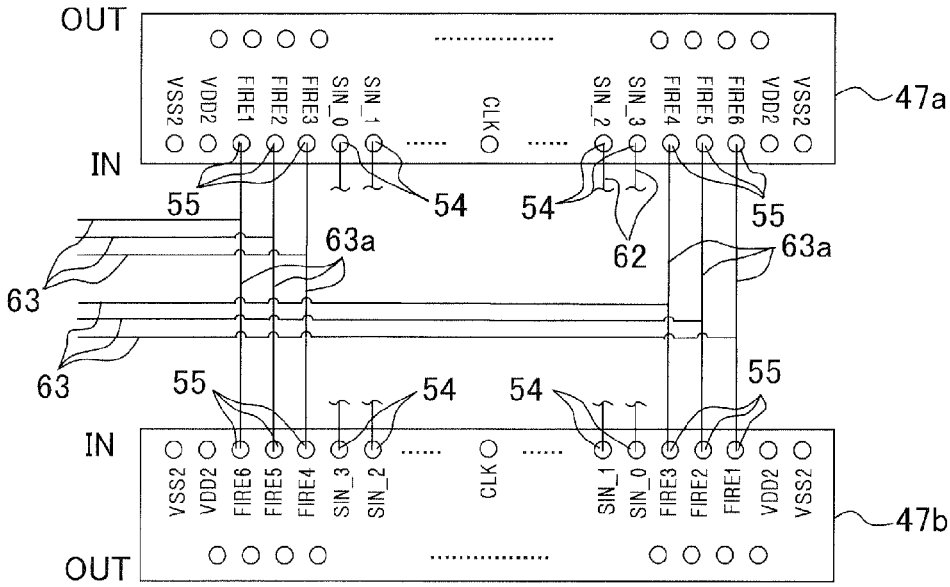
FIG. 8 is a view showing dispositions of input/output terminals in two driver ICs and a connection structure of common signal input terminals between the two driver ICs.

Next, the input/output terminals of the driver ICs 47 will be explained. In FIG. 8, the illustration of the two output sections 61 on the FFC 49 (portions connecting the FFC 49 to the FPC 48) existing between the two driver ICs 47, which are illustrated in FIG. 6, is omitted. As shown in FIG. 8, the driver ICs 47 each have an input/output terminal structure such that the input terminals (IN) disposed on one side and the output terminals (OUT) disposed on the other side are arranged in a single row respectively. Hereinafter, the disposition of the input terminals (IN) in each of the driver ICs 47 will be explained. The power supply input terminal (VDD2) and the ground input terminal (VSS2) among the input terminals (IN) are disposed at both sides in an arrangement direction respectively. On the other hand, the input terminals (CLK, and SIN_0 to SIN_3) to which the clock for data transfer and the waveform selection signals are inputted are disposed at a center region in the arrangement direction away from the power supply inputs. The clock for data transfer and the waveform selection signals are high frequency signals that are greatly affected when noises are mixed thereinto, so that the input terminals (CLK, and SIN_0 to SIN_3) are disposed at the position away from the power supply inputs in order to prevent the mixture of noise. Concretely, at both sides of CLK positioned at the center region, two of selection signal input terminals 54 (SIN_0 to SIN_3) having the waveform selection signals inputted thereto respectively are disposed. Further, although the illustration is omitted in FIG. 8, the terminal to which the strobe signal (STB: see FIGS. 4, 9) for controlling each of the driver ICs 47 is inputted is also provided.

Further, between the selection signal input terminals 54 (SIN_0 and SIN_1) and the power supply input terminal (VDD2), and between the selection signal input terminals 54 (SIN_2 and SIN_3) and the power supply input terminal (VDD2), six types of common signal input terminals 55 (FIRE) to which the six types of driving waveform signals being the signals common to the two driver ICs 47 are inputted are disposed three by three to sandwich CLK. Further, the input terminal numbers of "FIRE1" to "FIRE6" are assigned to the six common signal input terminals 55, respectively, and then they are arranged in numerical order. That is, in the driver IC 47*a* positioned at the upper side in FIG. 8, the six common signal input terminals 55 are arranged in the order of FIRE1 to FIRE6 from the left in the drawing. Further, in the driver IC 47*b* positioned at the lower side in FIG. 8, they are arranged in the order of FIRE1 to FIRE6 from the right in the drawing. In other words, in the two upper and lower driver ICs 47*a*, 47*b*, the arrangement directions of the six common signal input terminals 55 (FIRE1 to FIRE6) are reverse to each other.

<A Circuit Configuration of the Driver IC>

Figure 9:
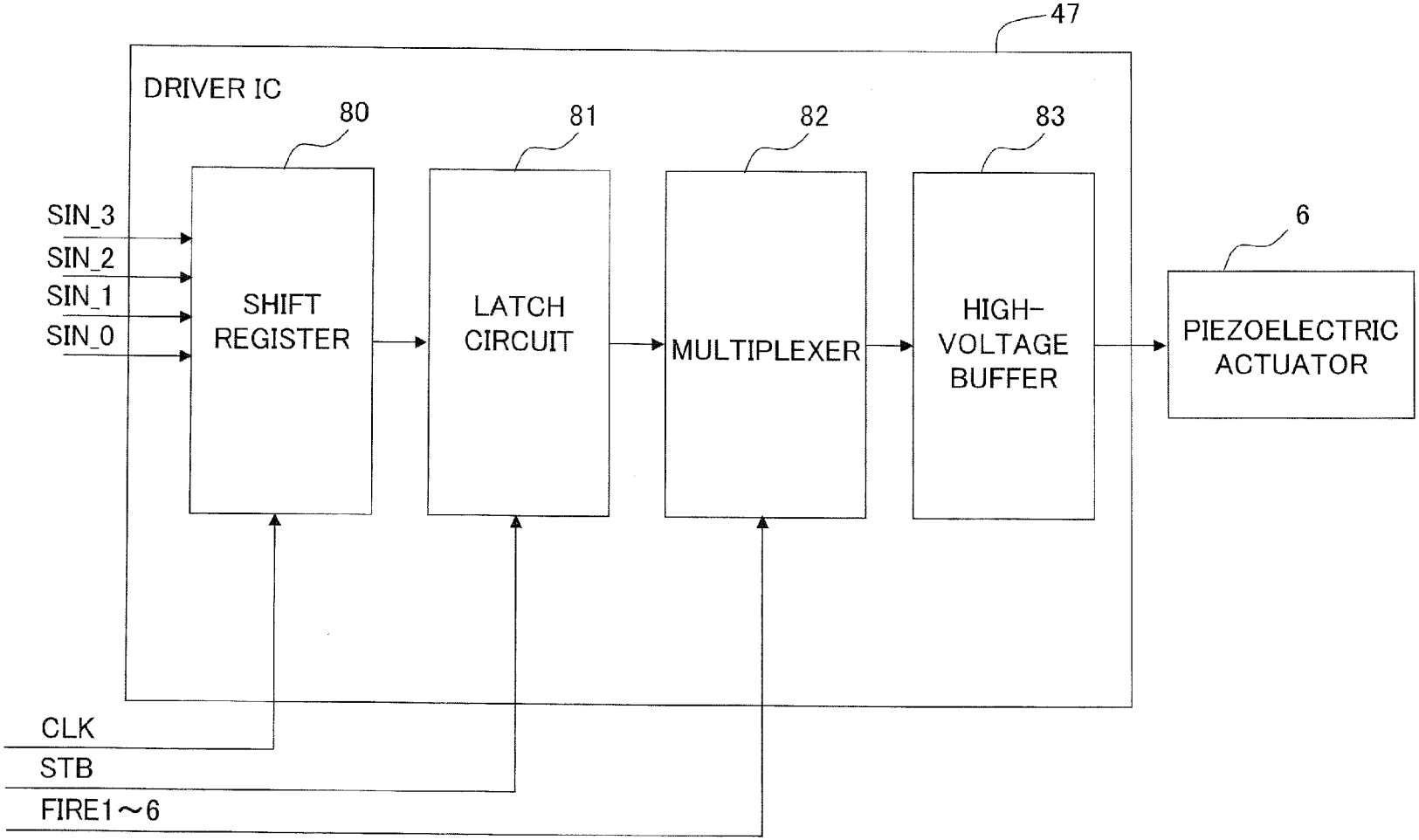
FIG. 9 is a block diagram schematically showing a circuit configuration of each of the driver ICs.

As shown in FIG. 9, the driver ICs 47 are each provided with a shift register 80, a latch circuit 81, a multiplexer 82, and a high-voltage buffer 83.

The 3-bit waveform selection signals corresponding to the respective nozzles 30 (respective individual electrodes 42) to be driven are inputted in series (serially inputted) to the shift registers 80 through the four selection signal input terminals 54 (SIN_0 to SIN_3) from the control board 9 in synchronization with the data transfer clock (CLK). Then, the shift registers 80 sequentially hold the 3-hit waveform selection signals to be serially inputted, and when the transfers of the waveform selection signals with respect to all the nozzles 30 are finished, they convert these 3-bit waveform selection signals into parallel signals to parallel output the parallel signals to the latch circuits 81. Incidentally, although it may also be designed so that the 3-bit waveform selection signal is serially inputted to the shift registers 80 from the control board 9 through the single individual wiring 62 (see FIG. 6) on the FFC 49, from the viewpoint of improving a transfer speed, it is designed so that the waveform selection signals are inputted to the four selection signal input terminals 54 (SIN_0 to SIN_3) by the four individual wirings 62 simultaneously in this embodiment.

The latch circuits 81, in accordance with the strobe control signal (STB) inputted from the control board 9, parallel output the parallel converted 3-bit waveform selection signals with respect to all the nozzles 30 to the multiplexers 82 at a predetermined timing. The six types of driving waveform signals (see FIG. 7) inputted to the six common signal input terminals 55 (FIRE1 to FIRE6) respectively are inputted to the multiplexers 82 (signal selection circuits). Then, the multiplexers 82 select the single type from the six types of driving waveforms for each of the nozzles 30 (individual electrodes 42) based on the waveform selection signals inputted from the latch circuits 81. The driving waveforms determined in this manner are amplified in the high-voltage buffers 83, and the drive signals at a power supply voltage level (that is, for example, 20V) are generated. Then, the drive signals having the predetermined driving waveforms are outputted to the individual electrodes 42 corresponding to the nozzles 30 to be driven from the output terminals (OUT) connected to the high-voltage buffers 83.

<Connection of the Common Signal Input Terminal and the Common Wiring>

Figure 13:
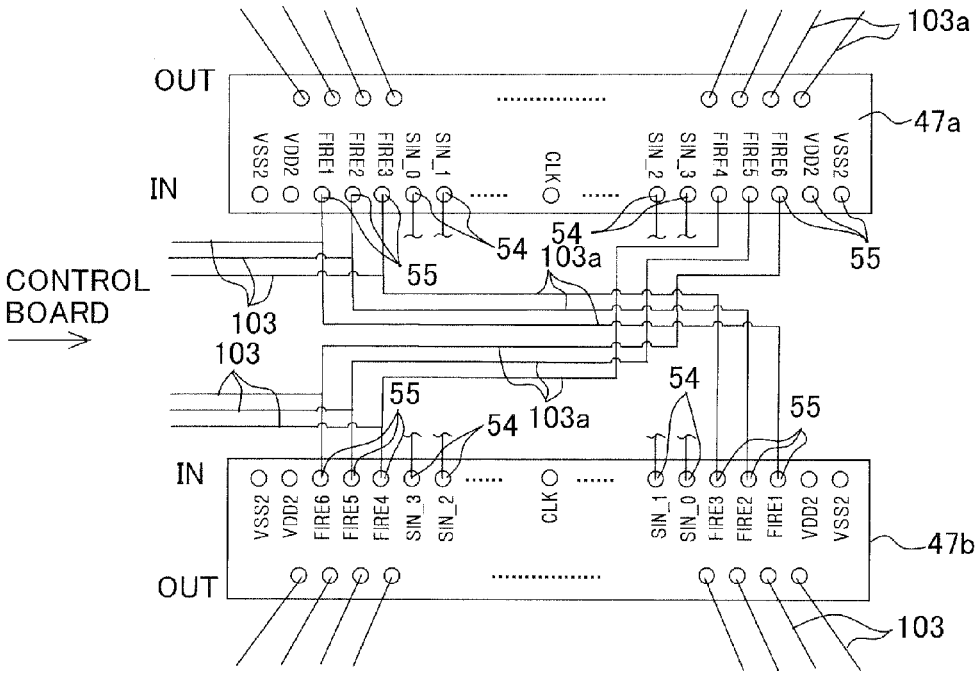
FIG. 13 is an arrangement diagram of the input/output terminals in the two driver ICs, which shows a connection structure of the common signal input terminals between the two driver ICs when the present invention is not applied.

As described above, the multiplexers 82 in the driver ICs 47, based on the waveform selection signal, each select the single specific type inputted from the single common signal input terminal 55 from among the six types of driving waveforms inputted from the six common signal input terminals 55 (FIRE1 to FIRE6), respectively. Thus, in general, the multiplexers 82 are configured so that the same driving waveform signals are inputted to the common signal input terminals 55 with the same input terminal number between the two driver ICs 47. However, in the case, the single common wiring on the FFC 49 through which the single type of driving waveform signal is transmitted is to be connected to the common signal input terminals 55 with the same input terminal number in the two driver ICs 47. In the above case, as shown in FIG. 13 that has been cited previously, intersecting portions in which branch lines 103*a* of six common wirings 103 intersect with one another are increased, so that noises are easily mixed into the driving waveform signals to be transmitted by the common wirings 103. Further, as is this embodiment in particular, in the case when the wiring board on which the common wirings are provided is the flexible board (FFC 49), flexibility reduces at the portions in which the wirings intersect, so that it is preferable to reduce the intersecting portions also from the above viewpoint.

Thus, in this embodiment, as shown in FIG. 8, the six common wirings 63 through which the six types of driving waveform signals are transmitted respectively are disposed on the FFC 49. Then, they are arranged so that branch lines 63*a* of these six common wirings 63 do not intersect between the two driver ICs 47. In FIG. 8, illustration of parts or all of the wirings except the common wirings 63 through which the driving waveform signals (FIRE) are transmitted is omitted for comparison with FIG. 13. Specifically, the individual wirings 62 through which the waveform selection signals (SIN_0 to SIN_3) are transmitted, the wiring for the transfer clock (CLK), the wirings connected to VDD2. VSS2, and so on are omitted in FIG. 8.

In the two driver ICs 47, the arrangement directions of the common signal input terminals 55 (FIRE) are reverse to each other. In other words, the input terminal numbers assigned for the common signal input terminals 55 in the driver IC 47*a* and the input terminal numbers assigned for the common signal input terminals 55 in the driver IC 47*b*, which are arranged in the same order from one side and are positioned to face with each other, differ. For example, in the driver IC 47*a* on the upper side in FIG. 8, the second terminal from the left is assigned to "FIRE2". In contrast to this, in the driver IC 47*b* on the lower side, the second terminal from the left is assigned to "FIRE5". The branch lines 63*a* of the single common wiring 63 are connected to the two common signal input terminals 55 that are arranged in the same order from one side and differ in number as above respectively. In this manner, the six branch lines 63*a* connecting the common signal input terminals 55 in the two driver ICs 47 become parallel to one another, and the intersecting portions are only made when the common wiring 63 led out to a control board 9 side on the left in the drawing goes over the branch line 63*a* of the different common wiring 63. Consequently, the mixture of noise into the driving waveform signals is prevented.

However, when the above-described wiring connection structure is employed, the driving waveforms to be inputted to the common signal input terminals 55 with the same input terminal number differ between the two driver ICs 47. Thus, if the above structure is employed as it is, when the multiplexers 82 each select, based on the waveform selection signal, the driving waveform inputted from the certain common signal input terminal 55, either in the driver IC 47*a* or in the driver IC 47*b*, the selected driving waveform differs from the desired driving waveform set on the control board 9. Thus, the waveform selection signals are set on the control board 9 so that such a problem does not occur.

The selection signal generation circuit 71 on the control board 9 shown in FIG. 4 generates the six types of waveform selection signals composed of combinations of 3-bit data not corresponding to the six types of driving waveforms shown in FIG. 7 but corresponding to the input terminal numbers (FIRE1 to FIRE6) assigned for the six common signal input terminals 55 through which the driving waveform signals are inputted to the driver ICs 47 as shown in Table 1.

TABLE 1

| input terminal number | waveform selection signal | | | driving waveform IC_a | driving waveform IC_b |
|---|---|---|---|---|---|
| FIRE1 | 0 | 0 | 0 | non-jetting | LL |
| FIRE2 | 0 | 0 | 1 | S1 | L |
| FIRE3 | 0 | 1 | 0 | S2 | M |
| FIRE4 | 0 | 1 | 1 | M | S2 |
| FIRE5 | 1 | 0 | 0 | L | S1 |
| FIRE6 | 1 | 1 | 1 | LL | non-jetting |

In Table 1, "IC_a" represents the driver IC 47*a* on the upper side in FIG. 8, and "IC_b" represents the driver IC 47*b* on the lower side in FIG. 8 respectively. In the above case, as is clear from the columns of "driving waveform" in Table 1, the driving waveform corresponding to the single type of waveform selection signal differs between the two driver ICs 47.

In this manner, the same driving waveform signals separated through the single common wiring 63 are inputted to two common signal input terminals 55, of the two driver ICs 47, the input terminal number of which are different with each other. Thus, in the case when the certain driving waveform signal is selected in order to achieve the certain jetting mode, there is a need to make the multiplexers 82 select the driving waveform signals to be inputted to the common signal input terminals 55 different in input terminal number in the two driver ICs 47, respectively. Thus, the selection signal generation circuit 71 transmits the different waveform selection signals corresponding to the above-described different input terminal numbers to the two driver ICs 47. For example, the driving waveform S1 (small drop 1, see FIG. 7) is inputted to "FIRE2" in the driver IC 47*a* on the upper side and is inputted to "FIRE5" in the driver IC 47*b* on the lower side in FIG. 8. Therefore, in the case when the multiplexers 82 are each made to select the driving waveform S1, the waveform selection signal of "001" corresponding to "FIRE2" in Table 1 is transmitted to the driver IC 47*a* on the upper side, and on the other hand, the waveform selection signal of "100" corresponding to "FIRE5" is transmitted to the driver IC 47*b* on the lower side.

That is, the selection signal generation circuit 71 on the control board 9 designates the input terminal number of the common signal input terminal 55 to which the driving waveform that should be selected by the multiplexer 82 in each of the driver ICs 47 is input. Thus, even though the single common wiring 63 is connected to the common signal input terminals 55 different in number between the two driver ICs 47, there is no case that the wrong driving waveform which is different from the correct driving waveform that should be selected originally is selected in the driver ICs 47. Further, in this manner, the control board 9 designates the common signal input terminals 55 to which the driving waveform signal that should be selected by the multiplexers 82 in the driver ICs 47 is inputted. Therefore, on a side of the multiplexers 82 in the driver ICs 47, it is only necessary to select the driving waveform inputted from the common signal input terminal 55 with the input terminal number corresponding to the waveform selection signal, and the circuit configurations of the driver ICs 47 do not become complicated.

Next, modifications in which various changes are made to the above-described embodiment will be explained. However, those having the same structures as those of the above-described embodiment are denoted by the same reference numerals and symbols and explanation thereof will be omitted when appropriate.

<First Modification>

In the above-described embodiment, as shown in Table 1, the selection signal generation circuit 71 on the control board 9 generates the six types of waveform selection signals composed of combinations of 3-bit data corresponding to the input terminal numbers (FIRE1 to FIRE6) of the six common signal input terminals 55 through which the driving waveform signals are inputted to the driver ICs 47. As shown in Table 2, the six types of waveform selection signals may also be generated corresponding to the six types of driving waveforms in FIG. 7.

TABLE 2

| driving waveform | waveform selection signal | | | input terminal number IC_a | IC_b |
|---|---|---|---|---|---|
| non-jetting | 0 | 0 | 0 | FIRE1 | FIRE6 |
| S1 | 0 | 0 | 1 | FIRE2 | FIRE5 |
| S2 | 0 | 1 | 0 | FIRE3 | FIRE4 |
| M | 0 | 1 | 1 | FIRE4 | FIRE3 |
| L | 1 | 0 | 0 | FIRE5 | FIRE2 |
| LL | 1 | 1 | 1 | FIRE6 | FIRE1 |

Similarly to the above-described embodiment, the single type of driving waveform signal to be transmitted by the single common wiring 63 is inputted to the common signal input terminals 55 different in number in the two driver ICs 47. However, in the case of Table 2, the waveform selection signal to be transmitted from the control board 9 does not correspond to the input terminal number of the common signal input terminal 55. Therefore, in practice, the driver ICs 47 can not recognize the input terminal number of the common signal input terminal 55 to which the driving waveform that should be selected by the multiplexers 82 is inputted, by only the above waveform selection signal.

Figure 10:
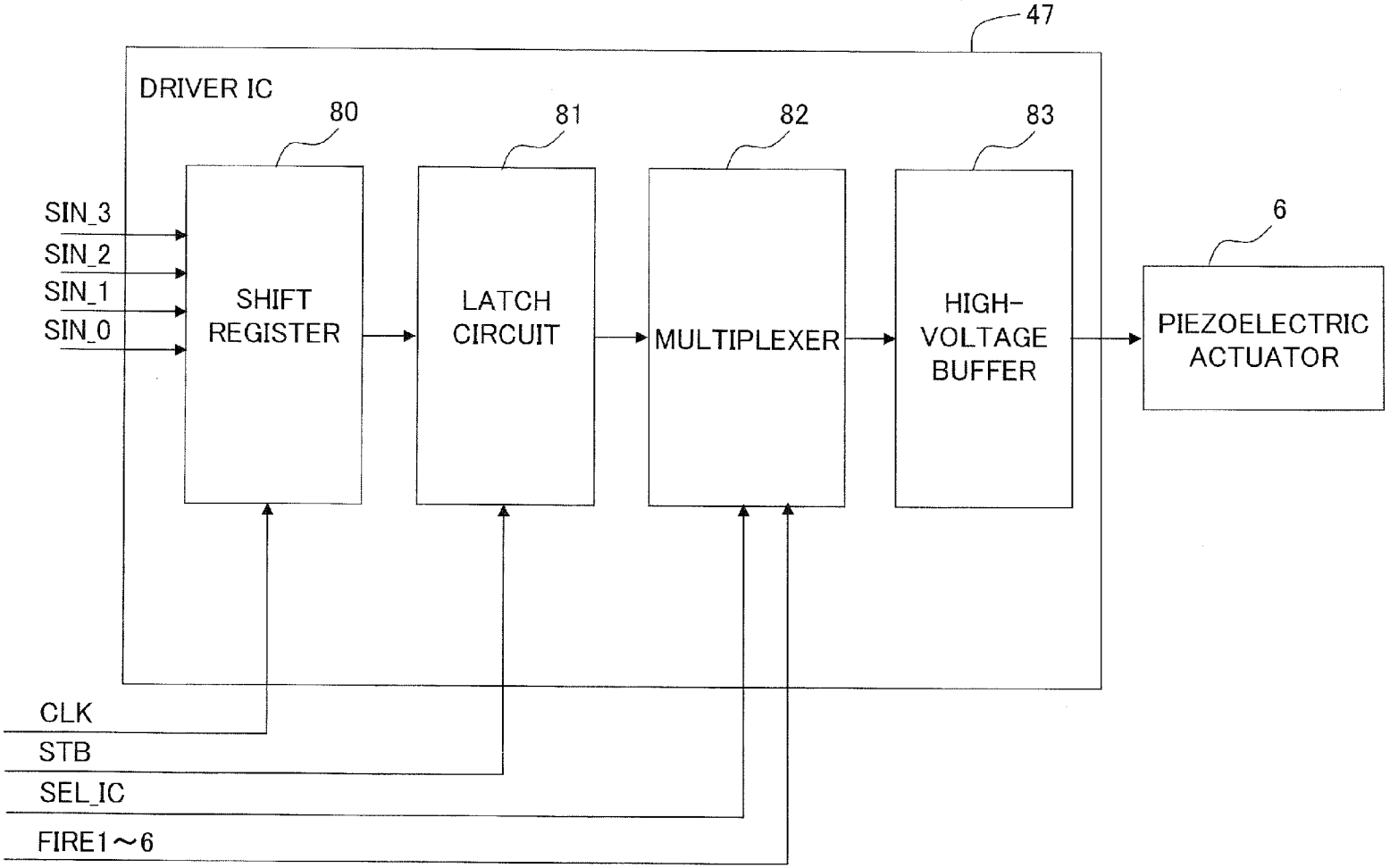
FIG. 10 is a block diagram schematically showing a circuit configuration of each of the driver ICs according to a modification embodiment.

Thus, in the above case, as shown in FIG. 10, an IC identification signal (SEL_IC) is transmitted to each of the driver ICs 47 from the control board 9. The IC identification signal identifies as to whether each of the multiplexers 82 corresponds to the driver IC 47*a* or corresponds to the driver IC 47*b*. On the other hand, in the respective driver ICs 47, correspondences between the waveform selection signals in Table 2 and the input terminal numbers of the common signal input terminals 55 are stored. Then, the multiplexer 82 in each of the driver ICs 47 recognizes which of the two driver ICs 47*a* and 47*b* the driver IC 47 corresponds to (whether the driver IC 47 corresponds to IC_a or IC_b in Table 2) by the IC identification signal (SEL_IC) transmitted from the control board 9. Further, when the waveform selection signal corresponding to the certain driving waveform signal is inputted, each of the multiplexers 82 specifies, from the relation in Table 2, which of the common signal input terminals 55 the driving waveform signal is inputted to. For example, in Table 2, when the waveform selection signal of "001" corresponding to the driving waveform of S1 is inputted to the driver IC 47*a* recognized as IC_a by the IC identification signal, the multiplexer 82 in the driver IC 47*a* specifies that an input destination of the driving waveform signal (the input terminal number of the common signal input terminal 55) to be designated by the waveform selection signal is "FIRE2", and selects the signal inputted from the terminal corresponding to "FIRE2".

Figure 11:
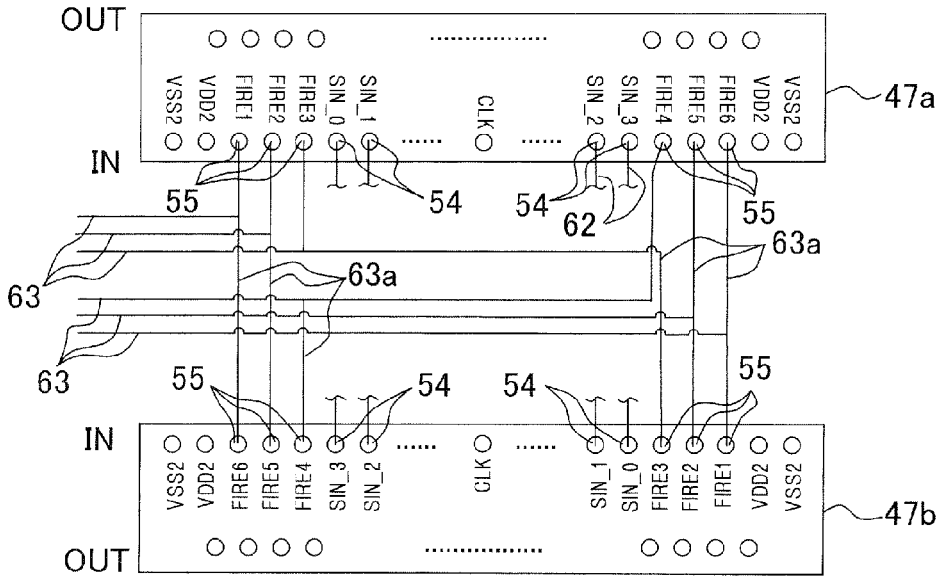
FIG. 11 is a view showing an example where only some of the common signal input terminals facing to each other are wired respectively.

The above-described embodiment, as is FIG. 8, for example, is formed in a manner that between the two driver ICs 47, all of the paired common signal input terminals 55 that are arranged in the same order from one direction and differ in number, (which make six pairs in total), are connected by the branch lines 63*a* respectively. However, the present teaching is not limited to this configuration, and it may also be designed in a manner that between the two driver ICs 47, among the common signal input terminals 55 that are arranged in the same order from one direction and duffer in number, at least some of the common signal input terminals 55 are connected to each other, and as for the other common signal input terminals 55, the common signal input terminals 55 with the same input terminal number are connected to each other. For example, as shown in FIG. 11, it may also be designed in a manner that, as for "FIRE1" and "FIRE2", and "FIRE5" and "FIRE6" that are positioned at the both sides of the common signal input terminals 55 in the arrangement direction, the terminals that differ in number but face to each other are wired respectively between the two driver ICs 47, and as for "FIRE3" and "FIRE4" that are positioned at the center of the common signal input terminals 55 in the arrangement direction, the terminals that have the same input terminal number but do not face to each other are wired between the two driver ICs 47.

Figure 12:
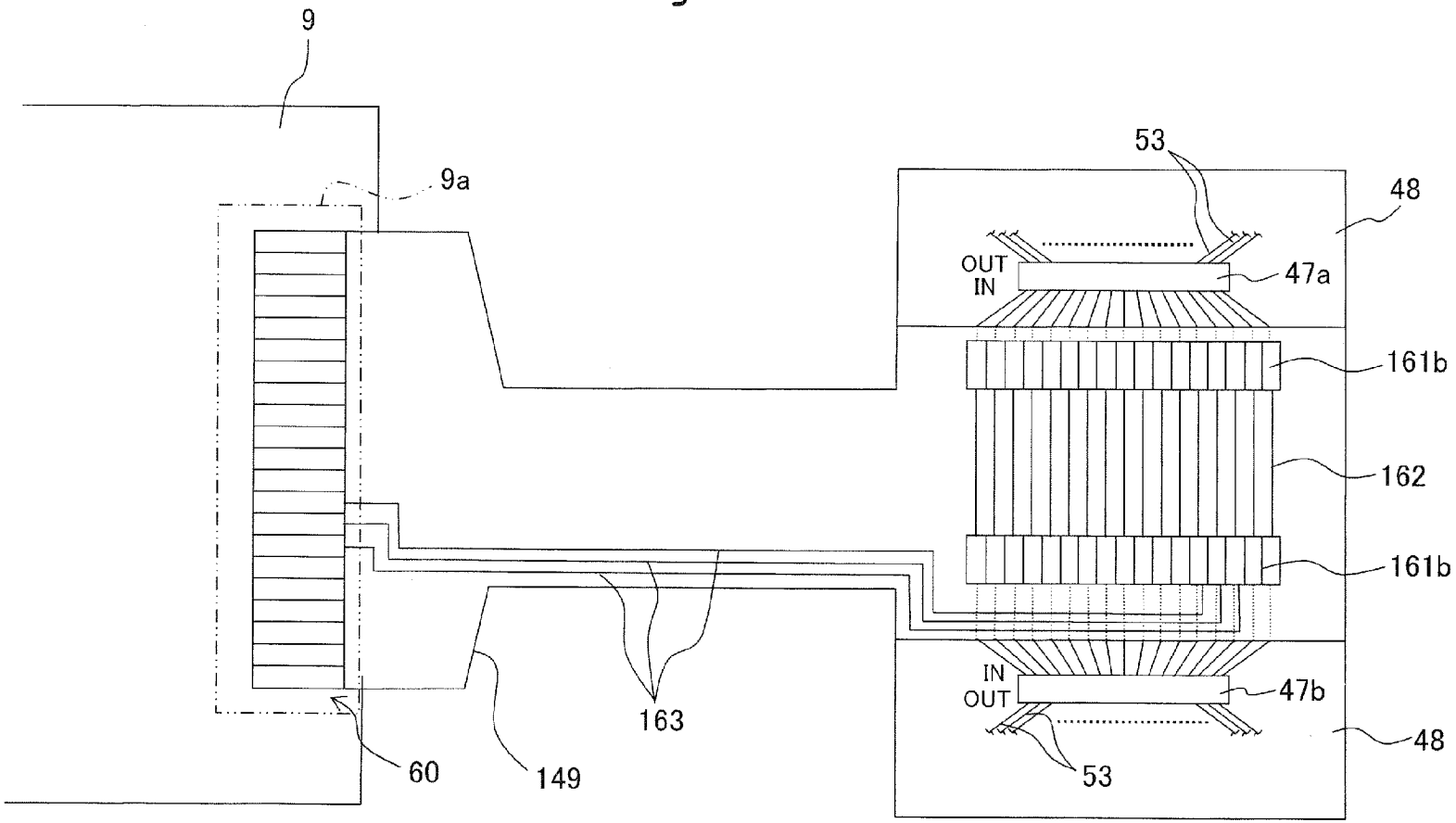
FIG. 12 is an upper surface view showing another example of the FFC and corresponding to FIG. 6.

In the above-described embodiment, as shown in FIG. 6, for example, the wirings 62, 63 on the FFC 49 are wired at an area located between the two output sections 61, but the present teaching is not limited to this configuration. For example, it may also be designed in a manner that wirings 162 are wired not between two connection terminals 161 but from the outside of connection terminals 161*a* on one side of the two connection terminals 161 as is a FFC 149 shown in FIG. 12. On the FFC 149, the connection terminals 161*a* on one side and connection terminals 161*b* on the other side that face to each other are wired by wirings 163 without the wirings 163 intersecting with one another therebetween. Here, in the connection terminals 161*a*, 161*b*, a not-illustrated covering material covering a rear surface of the FFC 149 is removed and metal portions of the wirings are exposed. The exposed metal portions are used as terminals for connecting to another wiring board. In FIG. 12, the FFC 149 and the FPC 48 having the driver ICs 47*a*, 47*b* disposed thereon are connected to each other in the connection terminals 161*a*, 161*b*. On the FFC 149 shown in FIG. 12, the wirings 162, 163 do not have portions intersecting with each other. Thus, it is possible to reduce a possibility that noises are mixed into the wirings 162, 163. Further, in the case when the wirings have the intersecting portions as is the FFC 49 in the above-described embodiment, it is not possible to use a wiring board having wirings formed only on its one surface, and for example, a multilayer wiring board having wirings formed on its both surfaces such as a double-sided FFC has to be used. In contrast to this, on the FFC 149 shown in FIG. 12, the wirings 162, 163 do not have portions intersecting with each other, so that it is possible to use a wiring board having wirings formed only on its one surface and to achieve a reduction in cost.

In the above-described embodiment, the FPC 48 having the two driver ICs 47 mounted thereon and the control board 9 are connected by the FFC 49 and thereby the control board 9 and the driver ICs 47 are connected, but it is not always necessary to use the FFC 49, and the wiring board having the driver ICs 47 mounted thereon and the control board 9 may also be directly connected.

The wiring board having the driver ICs 47 to be mounted thereon and the wiring board connecting the driver ICs 47 and the control board 9 are not necessary to be the flexible boards, but may also be hard printed circuit boards.

The above-described embodiment is one example where the present teaching is applied to controlling driving of the piezoelectric actuator, but it is also possible to apply the present teaching to another drive system actuator. Further, it is also possible to apply the present teaching not only to the case when the actuator of the ink-jet head is driven but also to a drive control structure of an actuator that is used in another technical field as long as the drive control structure of an actuator is one in which one type is selected from among a plurality of types of common signals and is used for a drive signal of the actuator.

What is claimed is:

1. A drive control device which controls driving of an actuator, comprising:

a wiring board connected to the actuator;

two driver ICs which are mounted on the wiring board, each of which generates a drive signal for driving the actuator, and each of which includes a plurality of input terminals arranged in one direction; and a control section which is connected to the wiring board, which generates a plurality of types of common signals to be used in common in the two driver ICs and a plurality of types of selection signals for selecting one type of the common signals from the plurality of types of common signals, and which sends the common signals and the selection signals to the two driver ICs, respectively, to control the two driver ICs;

wherein the input terminals in each of the driver ICs include a plurality of common signal input terminals to which the plurality of types of common signals are inputted and a plurality of selection signal input terminals to which the selection signals are inputted;

wherein the wiring board includes a plurality of common wirings which connect the common signal input terminals in one of the two driver ICs and the common signal input terminals in the other of the two driver ICs, respectively, and through which the plurality of types of common signals are inputted to the common signal input terminals in both of the two driver ICs, respectively;

wherein the two driver ICs are disposed on the wiring board to face to each other so that the common signal input terminals in one of the driver ICs and the common signal input terminals in the other driver IC are arranged in reverse order with respect to one another;

wherein two common signal input terminals, of the common signal input terminals, which are provided in the two driver ICs, respectively, and which are disposed in a same arrangement order when counted from one side of the wiring board in the one direction are wired by one of the common wirings;

wherein in each of the driver ICs the common signal input terminals are arranged to align in the one direction, and are individually numbered in order of the alignment from one end of the one of the driver ICs in the one direction;

wherein each of the driver ICs includes a signal selection circuit which selects the one type of the common signals to be used for generating the drive signal from the common signals inputted from the plurality of common signal input terminals respectively, based on the selection signal under a condition that one of the plurality of types of selection signals is inputted input terminal;

wherein one of the common wirings is connected to the two common signal input terminals which are provided in the two driver ICs respectively and are numbered in different numbers;

wherein the control section generates the plurality of types of selection signals corresponding to the numbers of the common signal input terminals; and wherein, in the case when the signal selection circuits selects the common signals to be transmitted to the two driver ICs by the common wiring connected to the two common signal input terminals which are numbered in different numbers between the two driver ICs respectively, the control section transmits the different selection signals corresponding to the different numbers to the two driver ICs, respectively.

2. The drive control device of the actuator according to claim 1;

wherein pairs of the common signal input terminals are connected by the common wirings, respectively, each of the pairs of the common signal input terminals including two of the common signal input terminals of the two driver ICs, and arrangement orders of the two of the common input terminals in the one direction from one side of the wiring board being the same.

3. The drive control device of the actuator according to claim 1;

wherein the wiring board is a flexible board.

4. The drive control device of the actuator according to claim 1;

wherein the control section transmits an IC identification signal to the two driver ICs to inform the driver ICs as to which one of the two driver ICs the informed driver IC corresponds to; and wherein the signal selection circuits specify the number of the common signal input terminal to which the common signal is inputted based on the IC identification signal, under a condition that the selection signals, which correspond to the common signals to be transmitted to the two driver ICs via the common wiring that is connected to the two common signal input terminals numbered in different numbers between the two driver ICs, respectively, are inputted.

5. The drive control device of the actuator according to claim 1;

wherein the wiring board includes:

a first flexible wiring board having the two driver ICs disposed thereon and connected to the actuator; and a second flexible wiring board having one end thereof connected to the control section and having the other end thereof wiring the two common signal input terminals in the two driver ICs, respectively.

6. The drive control device of the actuator according to claim 5;

wherein the first flexible wiring board has both ends thereof connected to the second flexible wiring board, is arranged to form a loop shape, and is connected to the actuator at a center portion of the loop shape.

7. The drive control device of the actuator according to claim 5;

wherein the second flexible wiring board is a single-sided wiring board having wirings formed only on one surface thereof.

8. The drive control device of the actuator according to claim 7;

wherein the second flexible wiring board includes a plurality of connection terminals connected to the common signal input terminals in the two driver ICs respectively;

wherein the connection terminals form two connection terminal rows arranged to correspond to rows of the common signal input terminals in the two driver ICs respectively so that the two connection terminal rows face to each other to have a gap therebetween;

wherein the second flexible wiring board includes:

a plurality of first wirings which have one ends thereof connected to the control section and having the other ends thereof connected to one connection terminal row of the connection terminal rows on a side opposite to the other connection terminal row; and a plurality of second wirings which are included in the common wirings and which connect the connection terminals of the one connection terminal row and the connection terminals of the other connection terminal row respectively at an area of the second flexible wiring board between the one connection terminal row and the other connection terminal row; and wherein the plurality of first wirings and the plurality of second wirings are wired respectively so that the first and second wires do not intersect with each other.

9. An inkjet printer which jets a liquid droplet of ink onto a medium to perform printing, the inkjet printer comprising:

a transporting mechanism which transports the medium in a transporting direction;

an ink-jet head including an actuator which applies pressure to the ink and jetting a liquid droplet of the ink onto the medium transported by the transporting mechanism; and the drive control device according to claim 1 connected to the actuator.

* * * * *